US007367385B1

(12) United States Patent
Materna

(10) Patent No.: US 7,367,385 B1
(45) Date of Patent: May 6, 2008

(54) OPTIMIZED FINS FOR CONVECTIVE HEAT TRANSFER

(76) Inventor: Peter A. Materna, 81 Rector St., Metuchen, NJ (US) 08840-1540

( * ) Notice: Subject to any disclaimer, the term of this patent is extended or adjusted under 35 U.S.C. 154(b) by 356 days.

(21) Appl. No.: 11/172,413

(22) Filed: Jun. 30, 2005

Related U.S. Application Data

(63) Continuation-in-part of application No. 10/748,115, filed on Dec. 30, 2003, now abandoned, which is a continuation of application No. 09/671,531, filed on Sep. 27, 2000, now Pat. No. 6,668,915.

(60) Provisional application No. 60/156,364, filed on Sep. 28, 1999, provisional application No. 60/586,251, filed on Jul. 8, 2004.

(51) Int. Cl.
*F28F 13/00* (2006.01)
*F28F 7/00* (2006.01)

(52) U.S. Cl. ..... 165/146; 165/185; 361/697

(58) Field of Classification Search ..... 165/146, 165/147, 185, 903, 80.3; 361/697, 703
See application file for complete search history.

(56) References Cited

U.S. PATENT DOCUMENTS 4,049,051 A 9/1977 Parker
4,653,572 A 3/1987 Bennett et al.
4,693,307 A 9/1987 Scarselletta
4,730,233 A * 3/1988 Osterman ..... 361/693
4,765,397 A * 8/1988 Chrysler et al. ..... 165/104.33
4,869,313 A 9/1989 Fredley
4,899,810 A 2/1990 Fredley
4,953,634 A 9/1990 Nelson
5,002,123 A 3/1991 Nelson
5,062,411 A 11/1991 Karabin
5,109,919 A 5/1992 Sakuma et al.
5,437,328 A 8/1995 Simons
5,613,552 A * 3/1997 Osakabe et al. ..... 165/104.21
5,709,264 A 1/1998 Sweeney et al.
5,818,694 A * 10/1998 Daikoku et al. ..... 361/703
5,860,472 A * 1/1999 Batchelder ..... 165/185
6,116,335 A 9/2000 Beamer
6,118,656 A 9/2000 Wang
6,161,613 A 12/2000 Huenniger
6,234,239 B1 5/2001 Azar
6,269,002 B1 7/2001 Azar
6,308,771 B1 * 10/2001 Tavassoli ..... 165/80.3
6,663,992 B2 * 12/2003 Lehnert et al. ..... 429/26

* cited by examiner

*Primary Examiner*—Tho Duong
(74) *Attorney, Agent, or Firm*—Peter Materna

(57) ABSTRACT

The invention includes a heat transfer geometry having first and second flow channels in parallel with each other. The flow cross-sectional area of individual channels varies along the length of the flowpath, with one channel undergoing an expansion and the other undergoing a contraction. Different amounts of additional heat transfer surface are located within different regions. In at least some instances, contraction and expansion may occur as a result of a shift of both the left and right boundaries which principally define the channel, and may occur symmetrically with respect to a centerline of the individual channel. With a cell being a first channel and associated second channel, the overall exiting flow may be offset slightly from the overall entering flow. An array may be formed containing multiple cells, and cells at edges of the array may be atypical so that the overall array fits within a simple geometric envelope.

8 Claims, 7 Drawing Sheets

Flow direction

OPTIMIZED FINS FOR CONVECTIVE HEAT TRANSFER

CROSS-REFERENCE TO RELATED APPLICATIONS

This patent application claims the benefit of provisional patent application 60/586,251 filed Jul. 8, 2004, and also is a continuation-in-part of U.S. patent application U.S. Ser. No. 10/748,115 Dec. 30, 2003, now abandoned, which is a continuation of U.S. patent application Ser. No. 09/671,531 Sep. 27, 2000 which is now issued as U.S. Pat. No. 6,668,915, which claims the benefit of provisional 60/156,364 Sep. 28, 1999, all of which are incorporated herein by reference in their entirety.

FIELD OF THE INVENTION

This invention pertains to the field of convective heat transfer.

BACKGROUND OF THE INVENTION

In the field of convective heat transfer, there is in general a tradeoff between heat transfer and pumping power. Power to operate a pump or fan to move a fluid involved in heat transfer is often an expense associated with achieving heat transfer. This is especially of concern in heat exchangers in which the fluid on at least one side is gas such as atmospheric air. Also this is especially of concern when, as is usually the case, there are limitations on the overall space which can be occupied by the heat exchanger. Designs, tradeoffs and calculational methods for heat exchangers are given in "Compact Heat Exchangers" by Kays and London. There is a continuing need for improvement in regard to the tradeoff between heat transfer and pumping power. Such improvement would increase the efficiency of any of the various devices employing forced convection heat transfer or even natural convection heat transfer.

Issued U.S. Pat. No. 6,669,815 discloses a geometry of fins designed to provide an improved ratio of heat transfer to pressure drop or pumping power, by using fin-to-fin spacings which are different in different regions of a fin array. The fin geometry of that patent is shown in FIG. 1. The geometry illustrated in U.S. Pat. No. 6,668,915 accomplishes that intended goal, but in that geometry the flow may be subject to certain geometry-related flow losses at the changes of cross-sectional area. In U.S. Pat. No. 6,668,915, when the flow at transition region 175 of the second channel expands from a smaller flow cross-sectional area in region 170 to a larger flow cross-sectional area in region 180, the flow on the right side of the narrow region 170 of the channel essentially may not have to shift at all, while the flow on the left side of the narrow region 170 of the channel may have to shift considerably more. Such flow shifting and associated possible separation of flow from its adjacent solid boundary are possible sources of loss of pressure or head, and so it is desirable for the flow to have to shift as little as possible. In order to avoid such separation of flow from solid boundaries, it has typically been necessary to maintain the divergence angle of the flow at a sufficiently small value, which in turn has required a considerable length of transition region in order to achieve a desired expansion of cross-sectional area.

Accordingly, it is desirable to provide designs of the type disclosed in U.S. Pat. No. 6,668,915 but having improved flow patterns in the transitions between regions, such as to provide for smoother flow and hence smaller pressure losses associated with the expansion or contraction. It also is desirable for the transition region to occupy as little of the overall flow length of the heat exchanger as possible.

BRIEF SUMMARY OF THE INVENTION

The invention includes a heat transfer geometry having a first channel and a second channel which are fluid mechanically in parallel with each other, and with each channel including an upstream region and a downstream region which are of unequal cross-sectional areas. In the first channel, contraction may occur upon going from the upstream region of the channel to the downstream region, and in the second channel expansion may occur upon going from the upstream region of the channel to the downstream region. The channel boundaries may be heat transfer surfaces, and additional heat transfer surface area may be provided in specific regions of specific channels. In this invention, in at least some instances, contraction and expansion may occur as a result of a shift of both the left and right boundaries of the channel. In a cell which is a pairing of a first channel and a second channel sharing a common inter-channel boundary, the overall exiting flow may be offset slightly from the overall entering flow. The invention also includes an array of such cells. An array may be such that the overall array of cells occupies a simple geometric envelope, which may be achieved by providing some cells or structure near the edges of the array, which may be different from the cells in the central portion of the array.

BRIEF DESCRIPTION OF THE ILLUSTRATIONS

The invention is illustrated in the following Figures, in which:

FIG. 1 shows the heat transfer geometry described in U.S. Pat. No. 6,668,915.

FIG. 6 illustrates such an array with an edge region filled in.

DETAILED DESCRIPTION OF THE INVENTION

Figure 1:
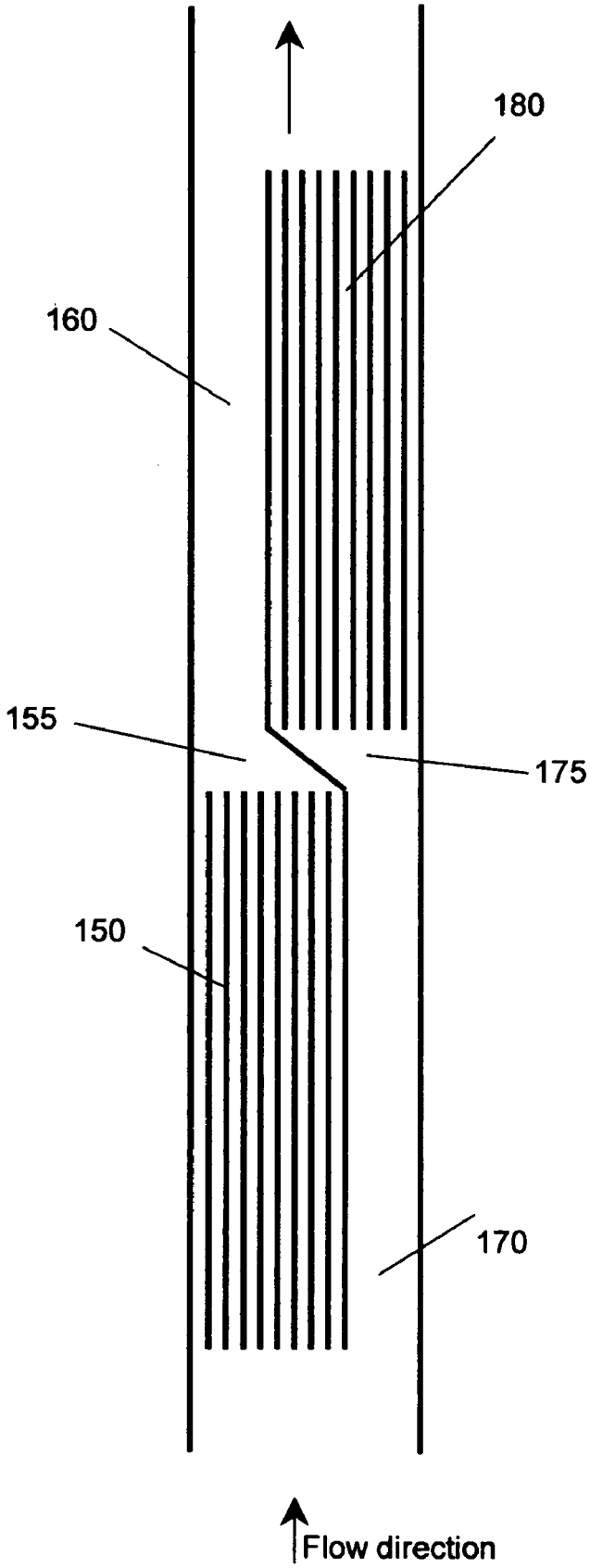

The invention includes a geometry of surfaces for heat exchange with a flowing fluid. The geometry may define a first channel for flow of a fluid and a second channel for flow of the fluid, with the first channel and the second channel being fluid mechanically in parallel with each other. The first and second channels may have overall flow resistances which are approximately equal to each other, and in the normal conditions of operation the first and second channels may carry flowrates which are approximately equal to each other.

The first channel may be defined at least in part by a first channel boundary 254 and an interchannel boundary 290. The second channel may be defined at least in part by the interchannel boundary 290 and a second channel boundary 274. The interchannel boundary 290 may be located between the first channel boundary 254 and the second channel boundary 274. In the direction into or out of the plane of the paper, the channels may be defined by still other boundaries.

The first channel may comprise a first channel upstream region 250 having a first channel upstream region flow cross-sectional area, in series with a first channel downstream region 260 having a first channel downstream region flow cross-sectional area. In the first channel, between the first channel upstream region 250 and the first channel downstream region 260, there may be a first channel transition region 255. Similarly, the second channel may comprise a second channel upstream region 270 having a second channel upstream region flow cross-sectional area, in series with a second channel downstream region 280 having a second channel downstream region flow cross-sectional area. In the second channel, between the second channel upstream region 270 and the second channel downstream region 280, there may be a second channel transition region 275.

For purposes of discussion, it can be considered that in the first channel the first channel upstream region 250 is of larger flow cross-sectional area and the first channel downstream region 260 is of smaller flow cross-sectional area, i.e., the first channel transition region 255 is converging. Similarly, it can be considered that in the second channel the second channel upstream region 270 is of smaller flow cross-sectional area and the second channel downstream region 280 is of larger flow cross-sectional area, i.e., the second channel transition region 275 is diverging. It is understood, however, that these designations could be interchanged. It is possible, although not required, that the sum of the first channel upstream flow cross-sectional area and the second channel upstream flow cross-sectional area can equal the sum of the first channel downstream flow cross-sectional area and the second channel downstream flow cross-sectional area.

For any of the transition regions 255 and 275, the transition can be formed by a shift of both of the two boundaries which principally define the particular channel (rather than a shift of only one of the two boundaries as was illustrated in U.S. Pat. No. 6,668,915). For example, in the first channel transition region 255, both the first channel boundary 254 and the interchannel boundary 290 can shift so as to decrease the flow cross-sectional area as the fluid proceeds from the first channel upstream region 250 to the first channel downstream region 260. These boundaries can shift in a substantially symmetric manner so that the first channel substantially maintains a symmetry about first channel centerline 292. Similarly, in the second channel transition region 275, both the second channel boundary 274 and the interchannel boundary 290 can shift so as to increase the flow cross-sectional area as the fluid proceeds from the second channel upstream region 270 to the second channel downstream region 280. Again, these boundaries can shift in a substantially symmetric manner so that the second channel substantially maintains a symmetry about its own centerline 294. Alternatively, it is possible for the various boundaries to shift in ways such that the individual channels do not maintain symmetry around their own respective centerlines.

If flow separates from adjacent solid boundaries, this generally creates additional pressure losses and is undesirable. Separation is typically associated with localized recirculating flow patterns. As investigated in the art of fluid mechanics dealing with diffusers, the question of whether or not an expanding flow separates from the walls which define its flowpath, or the extent of such separation, is determined by factors which include the angle of divergence of the walls. Accordingly, the angle of divergence alpha as defined in FIG. 2 (which is a half-angle of divergence rather than a full included angle) may be chosen so as to be less than 20 degrees, or less than 10 degrees, or less than 8 degrees, or less than 6 degrees, or any other angle which is appropriate for a given situation. In the second channel (which is the channel containing expansion 275), both the interchannel boundary 290 and the second channel boundary 274 may exhibit divergence at that angle; or, the angle at one of these boundaries may be different from the angle at the other of these boundaries. In the first channel, as determined by the first channel boundary 254 and the interchannel boundary 290, there may be convergence at a convergence angle similar to that of the just-described divergence. Curved or partially curved configurations of the various channel boundaries are also possible. In a situation which includes curved boundaries, the shape of the curve may be chosen so as to provide desirable flow patterns at the transitions. The boundaries of the transition may comprise straight segments with fillets at each end of the transition, as illustrated in FIG. 3.

Figure 4:
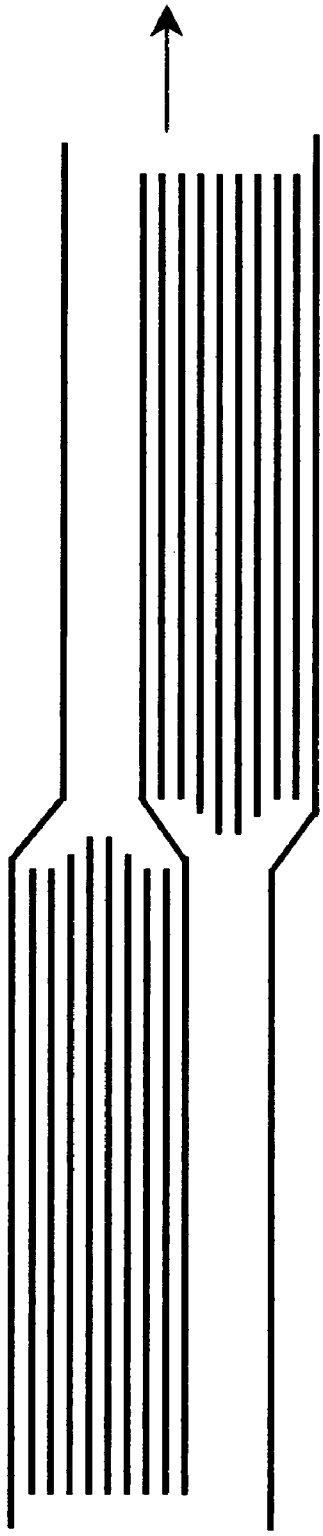
FIG. 4 illustrates a similar cell with unequal lengths of fins in certain regions of the flowpaths.

The first channel boundary 254, the interchannel boundary 290 and the second channel boundary 274 may all be disposed to engage in heat transfer with the fluid in the respective channels. Other boundaries of the channels (in the plane of the paper, not illustrated) may also be disposed to engage in heat transfer with the fluid in the respective channels, if desired. Any of the described regions can contain additional heat transfer surface area which may, for example, be in the form of fins. Alternatively or in addition, such additional heat transfer surface area can comprise perforated fins, or one or more fins punctured by one or more fluid-carrying tubes, or wire mesh, or a porous material, or pins, or tubes in crossflow, or tubes in other geometries. Although the first channel downstream region and the second channel upstream region are illustrated as not having any additional heat transfer surface area beyond the respective channel boundary and interchannel boundary, those regions could contain additional heat transfer surface area such as fins. Heat transfer for geometries other than simple fins, such as porous material or mesh, may be represented or approximated for calculation purposes as equivalent arrays of parallel-walled channels or tubes, as is known in the art, for example, the D'Arcy theory of flow through porous media. If fins are used for the additional heat transfer surface area in certain regions, the fins do not all have to be of the same length along the flow direction. FIG. 4 illustrates a pattern of unequal length fins which may be suitable.

Each region may have a heat transfer surface area associated with that region, which may be the sum of the heat transfer surface area of the appropriate channel boundary and the heat transfer surface area of the interchannel boundary and any additional heat transfer surface area which may be present in the particular region. The first channel upstream region total heat transfer surface area and the second channel upstream region total heat transfer surface area define a heat transfer surface area distribution factor which is the larger of those two quantities divided by their sum. The first channel upstream region flow cross-sectional area and the second channel upstream region flow cross-sectional area define a flow cross-sectional area distribution factor which is the larger of those two quantities divided by their sum. In the present invention, the heat transfer surface area distribution factor and the flow area distribution factor may be selected such that the heat transfer surface area distribution factor is greater than the flow cross-sectional area distribution factor. This criterion results in an improved value of heat transfer to pressure drop, as explained in greater detail in U.S. Pat. No. 6,668,915.

Figure 2:
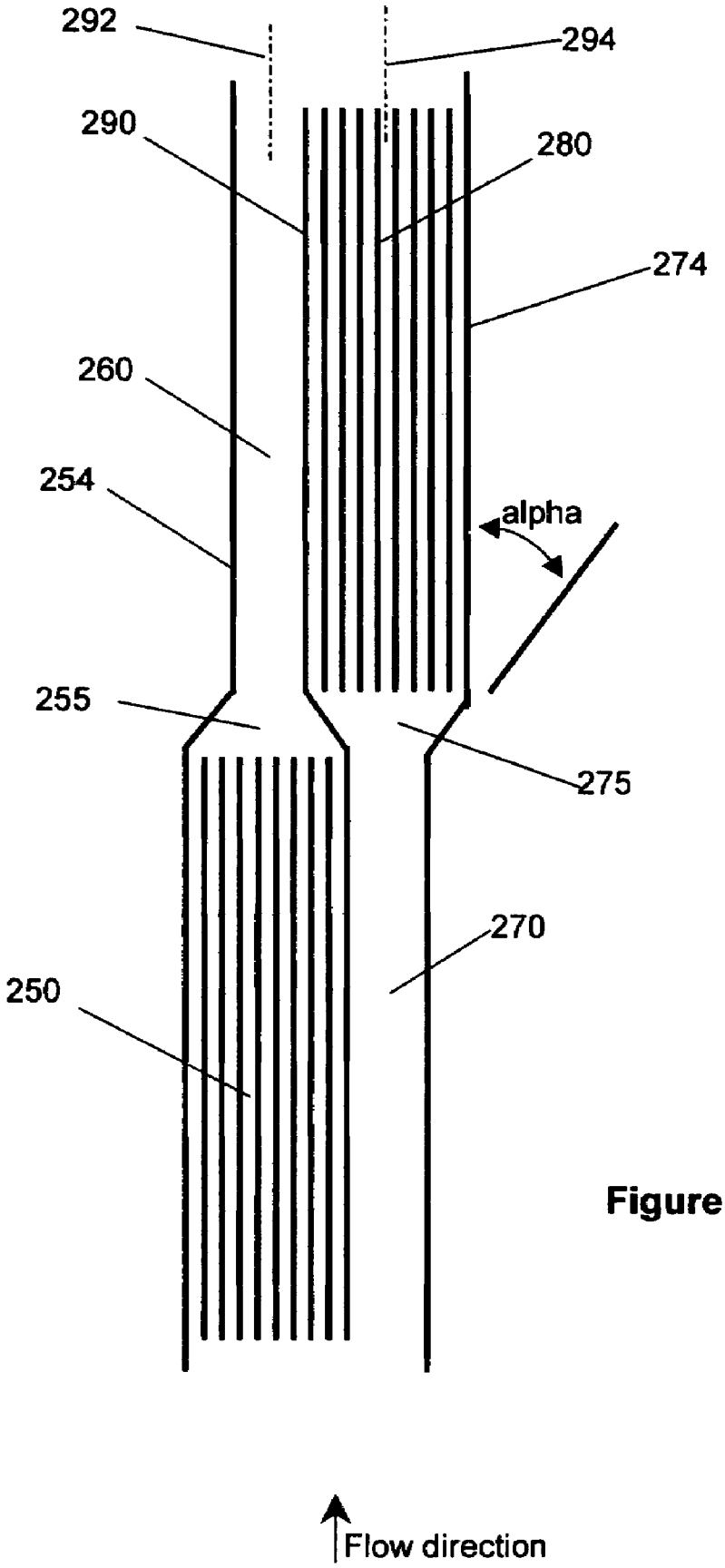
FIG. 2 illustrates a single cell, i.e., a paired first channel and second channel, of the present invention.
Figure 3:
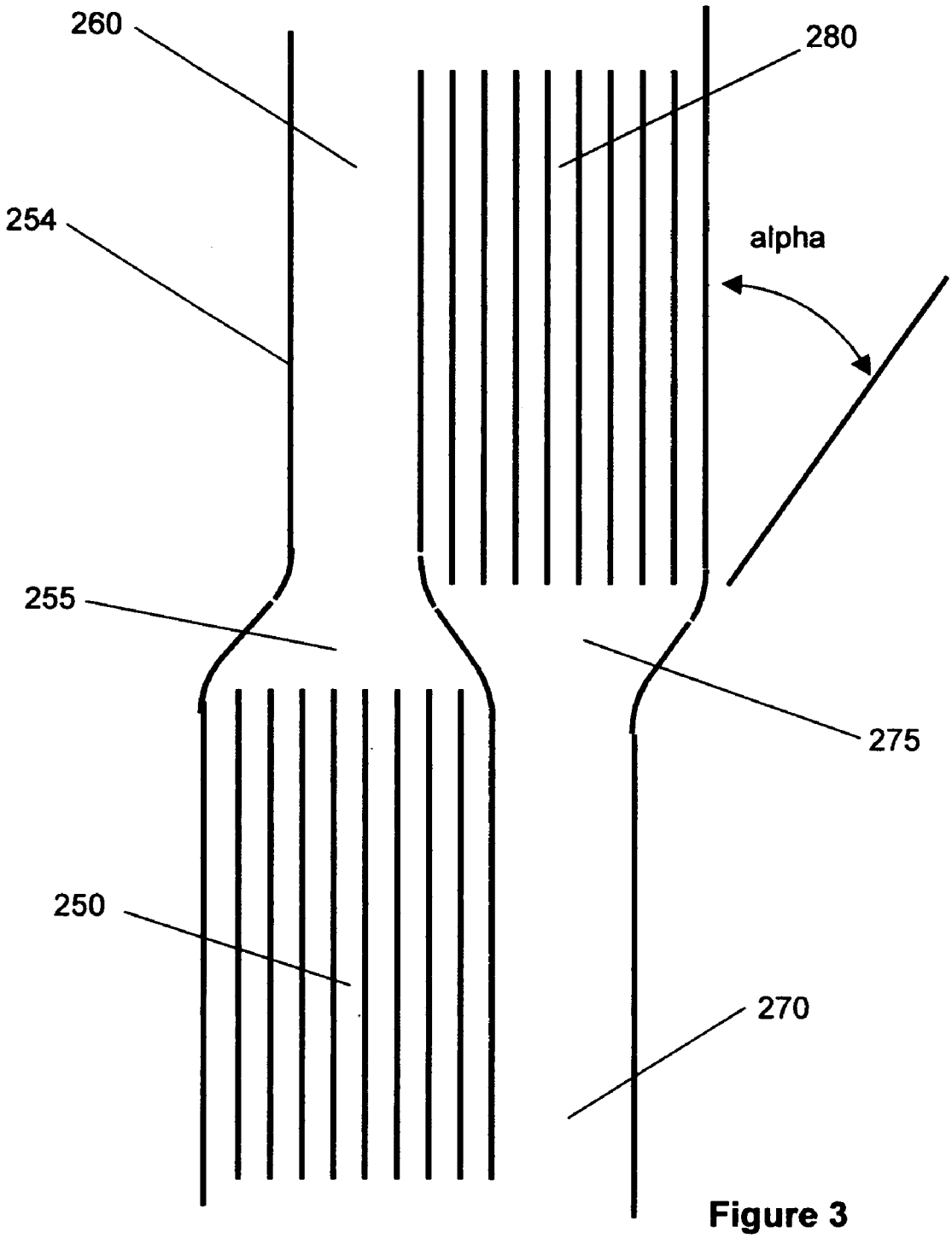
FIG. 3 is a close-up view showing a similar cell with curved boundaries.

It is possible that the various boundaries which define the first channel and the second channel may be arranged as illustrated in the FIG. 2, so that both the first channel maintains symmetry around its individual centerline 292 and the second channel maintains symmetry around its centerline 294. It can be observed that in this geometry the overall output of the combination of the two just-described flowpaths does not exactly line up with the overall input of the combination of the same two flowpaths. (This is in contrast to the situation for the geometry of U.S. Pat. No. 6,669,815 which is illustrated in FIG. 1.) Instead, in the design of FIG. 2, there is a slight offset of the overall flow in the downstream regions and at the exit of the combination of the two channels, relative to the overall flow in the upstream regions and at the entrance of the combination of the two channels. It may be that in a particular application this offset can be accommodated as described elsewhere herein, and that the improved flow situation at the expansion 275 and contraction 255 makes this worthwhile.

Figure 5:
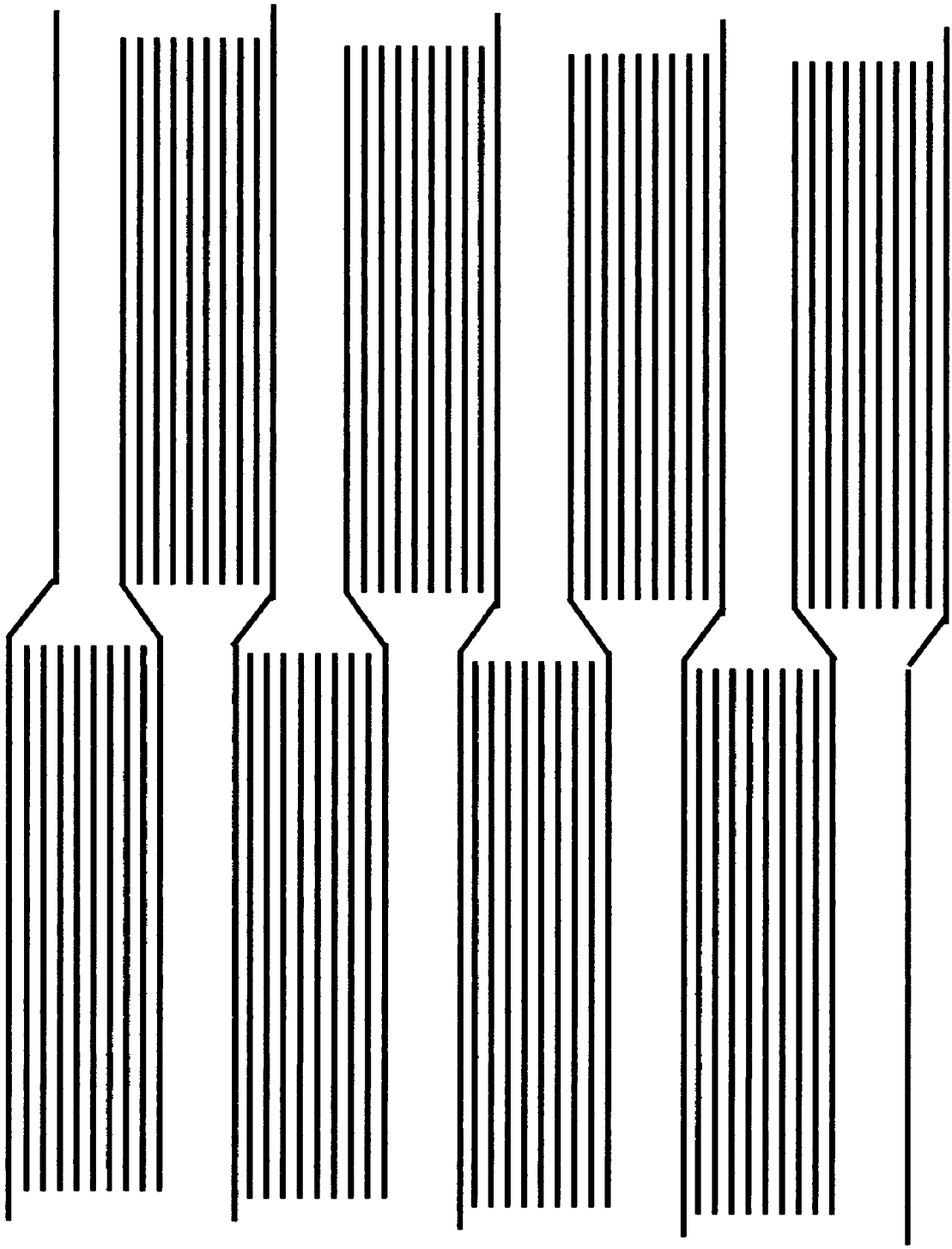
FIG. 5 illustrates an array of such cells arrayed side-by-side.

A cell or apparatus can be considered to be, collectively, the first channel and the second channel, which share a common interchannel boundary. The overall cell can be defined by the first channel boundary and the second channel boundary. The invention also includes an assembly containing a plurality of such cells arranged side by side with each other. The first channel upstream region and the second channel upstream region together define a cell upstream region which is bounded by the first channel wall and the second channel wall in that region. Similarly, the first channel downstream region and the second channel downstream region together define a cell downstream region which is bounded by the first channel wall and the second channel wall in that region. In such an assembly, the first channel boundary of a certain cell can, on the other side of that boundary, be the second channel boundary of another cell. Thus, the first channel boundary and the second channel boundary can be inter-cell boundaries and can engage in heat transfer with fluid on both of their sides. Multiple cells may be used together to make a heat exchanger occupying a substantial frontal area. This illustrated in FIG. 5 using four cells.

For an overall assembly of heat transfer surfaces, it may be desirable that the entire assembly (array of cells) should fit within a simple shape envelope which may be a simple rectangle.

Figure 6:
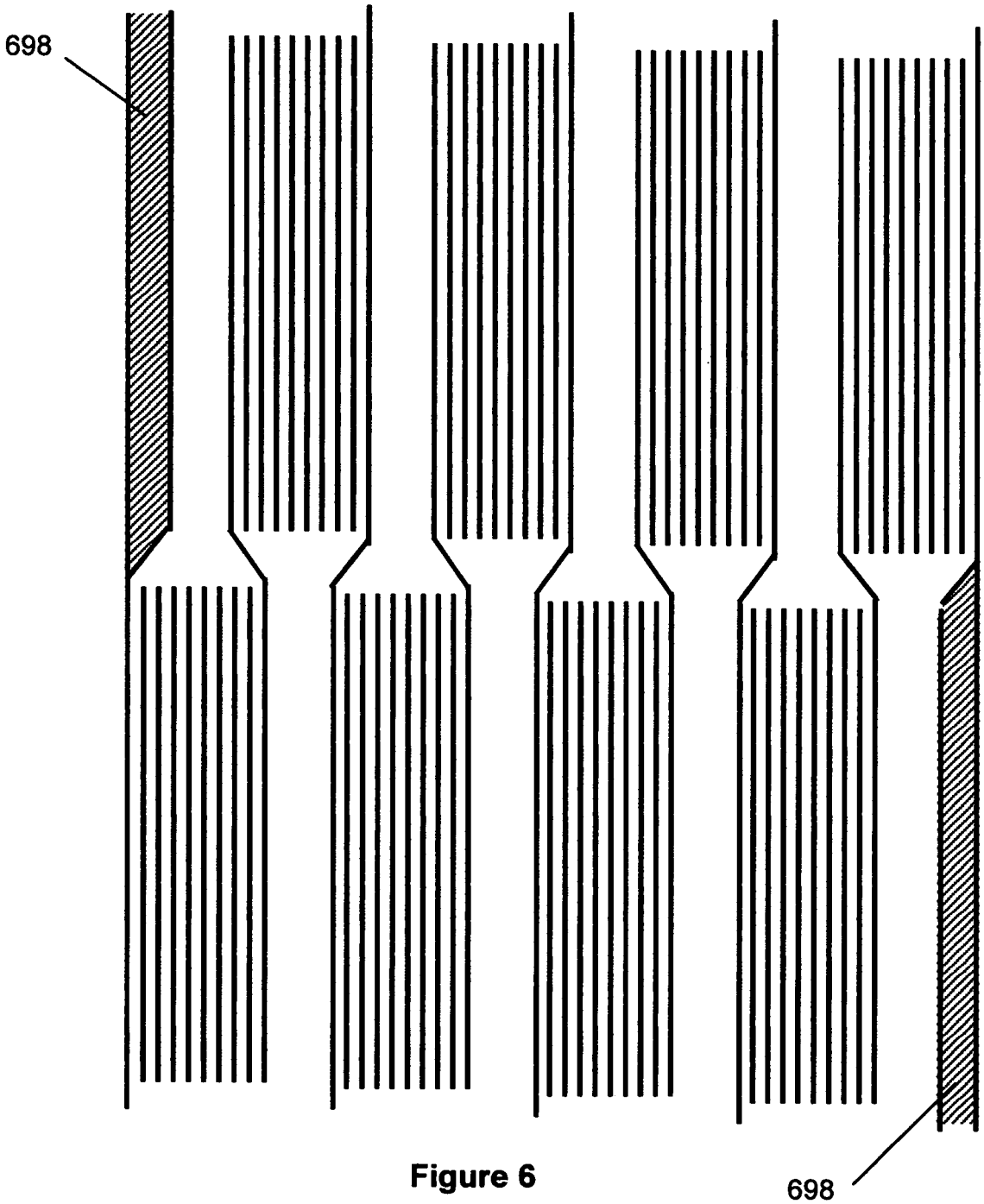

Use of a large number of cells could occur, for example, in a large heat exchanger requiring a large number of fins. If an application involves placement of many such cells side by side, it is possible that the slight offset (which would be less than half of the overall side-to-side dimension of one cell) may be a tiny fraction of to the overall side-to-side dimension of the assembly of cells. In this situation, there might be a fractional cell on the extreme left side and the extreme right side of the overall array which would be geometrically unavailable for flow, but this could be insignificant compared to the overall dimensions of the heat exchanger, and this space could simply be left unused for flow and heat exchange. This is illustrated in FIG. 6, showing those spaces filled with filler 698.

Figure 7:
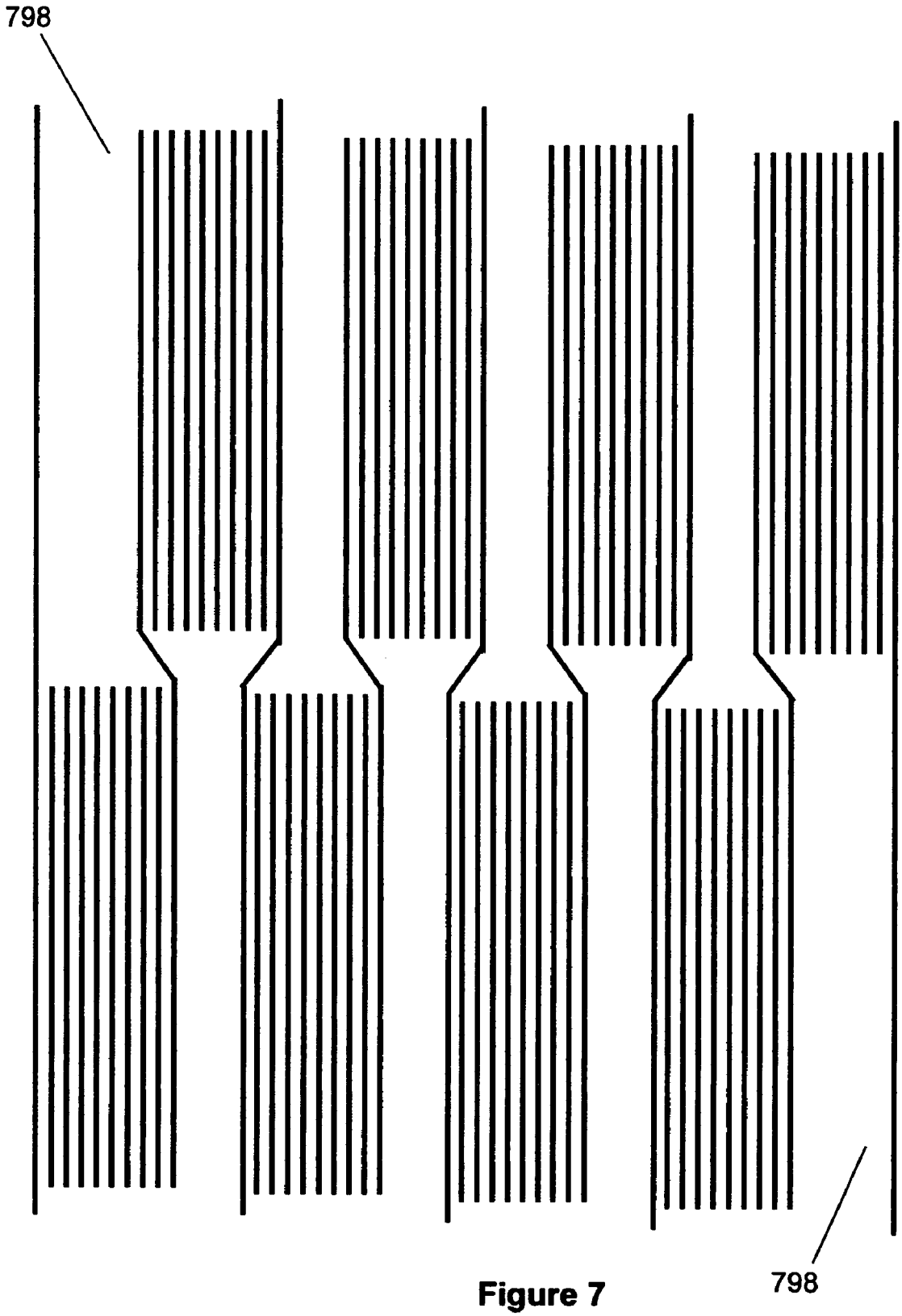
FIG. 7 illustrates such an array with edge regions made part of the appropriate flowpaths.

Alternatively, to avoid "wasting" any space in the frontal area of a heat exchanger, it is possible that a number of cells can be manufactured using the design described herein and can be centrally located in an array, and at least one cell of some other configuration can be manufactured near the boundary of the cell array, so as to give the overall array of cells the desired envelope. For example, for such unique cells the flow area distribution factor could be different from what it is in cells in the central region of the heat exchange array. This is illustrated in FIG. 7, in which the left flowpath of the extreme left cell is different from that in typical cells, and the right flowpath in the extreme right cell is different from that in typical cells. Extra space left in as flow area is shown in FIG. 7 as regions 798. It is also possible to have an unmatched flowpath or half-cell, i.e., the number of expansion-containing flowpaths in the overall array could be one more or one less than the number of contraction-containing flowpaths in the overall array.

Although various embodiments of the invention have been disclosed and described in detail, it should be understood that this invention is in no way limited thereby and its scope is to be determined by that of the appended claims.

I claim:

1. An apparatus for engaging in heat transfer with a flowing fluid, comprising:

a first channel boundary which is a heat transfer surface and an interchannel boundary which is a heat transfer surface, the first channel boundary and the interchannel boundary at least partially defining a first channel which is configured to confine a first channel flow of the fluid, the first channel boundary and the interchannel boundary both being disposed to engage in heat transfer with the fluid in the first channel; and a second channel boundary which is a heat transfer surface, located such that the interchannel boundary is between the first channel boundary and the second channel boundary, the second channel boundary and the interchannel boundary at least partially defining a second channel which is configured to confine a second channel flow of the fluid, the second channel boundary and the interchannel boundary both being disposed to engage in heat transfer with the fluid in the second channel, the first channel comprising a first channel upstream region having a first channel upstream region flow cross-sectional area, in series with a first channel downstream region having a first channel downstream region flow cross-sectional area, the second channel comprising a second channel upstream region having a second channel upstream region flow cross-sectional area, in series with a second channel downstream region having a second channel downstream region flow cross-sectional area, the first channel upstream region flow cross-sectional area being greater than the first channel downstream region flow cross-sectional area, the second channel downstream region flow cross-sectional area being greater than the second channel upstream region flow cross-sectional area, and further comprising, the first channel upstream region, additional first channel upstream region heat transfer surface disposed to engage in heat transfer with the fluid in the first channel upstream region, and, in the second channel downstream region, additional second channel downstream region heat transfer surface disposed to engage in heat transfer with the fluid in the second channel downstream region, wherein the first channel upstream region has a first channel upstream region total heat transfer surface area in contact with the fluid in the first channel upstream region, and the first channel downstream region has a first channel downstream region total heat transfer surface area in contact with the fluid in the first channel downstream region, and the second channel upstream region has a second channel upstream region total heat transfer surface area in contact with the fluid in the second channel upstream region, and the second channel downstream region, has a second channel downstream region total heat transfer surface area in contact with the fluid in the second channel downstream region, and wherein the first channel upstream region total heat transfer surface area and the second channel upstream region total heat transfer surface area define a heat transfer surface area distribution factor which is the larger of those two quantities divided by their sum, and the first channel upstream region flow cross-sectional area and the second channel upstream region flow cross-sectional area define a flow cross-sectional area distribution factor which is the larger of those two quantities divided by their sum, and wherein the heat transfer surface area distribution factor is greater than the flow cross-sectional area distribution factor, and further wherein the first channel comprises a first channel transition region between the first channel upstream region and the first channel downstream region, and the second channel comprises a second channel transition region between the second channel upstream region and the second channel downstream region, and the first channel transition region comprises a displacement of both the first channel boundary and the interchannel boundary, and the second channel transition region comprises a displacement of both the interchannel boundary and the second channel boundary.

2. The apparatus of claim 1, wherein the first channel transition region has symmetry around a first channel centerline and the second channel transition region has symmetry around a second channel centerline.

3. The apparatus of claim 1, wherein the transition from the second channel upstream region to the second channel downstream region comprises an expansion whose divergence half-angle is less than approximately 20 degrees.

4. The apparatus of claim 1, wherein the transition from the second channel upstream region to the second channel downstream region comprises an expansion whose divergence half-angle is less than approximately 10 degrees.

5. The apparatus of claim 1, wherein the first channel transition region and the second channel transition region are defined at least in part by boundaries which are curved.

6. An array comprising a plurality of the apparatuses of claim 1, the apparatuses being arranged in side-by-side relationship with each other, the first channel boundary of one apparatus being the second channel boundary of a neighboring apparatus.

7. The array of claim 6, wherein substantially all of the apparatuses are substantially identical to each other.

8. The array of claim 6, further comprising at extreme edges, other apparatuses carrying flow and having heat transfer surface area, the other apparatuses being suitable to provide a simple overall envelope for the array plus the other apparatuses.

* * * * *